US005306107A

United States Patent [19]

Kageyama et al.

[11] Patent Number: 5,306,107

[45] Date of Patent: Apr. 26, 1994

[54] TWIN-TYPE STICK-SHAPED MATERIAL EXTENDING CONTAINER

[75] Inventors: Shuhei Kageyama; Shoji Anzai; Yoshihide Mitsuya, all of Kawagoe, Japan

[73] Assignee: Kotobuki & Co., Ltd., Kyoto, Japan

[21] Appl. No.: 22,808

[22] Filed: Feb. 22, 1993

Related U.S. Application Data

[63] Continuation of Ser. No. 805,376, Dec. 9, 1991, abandoned.

[30] Foreign Application Priority Data

Dec. 28, 1990 [JP] Japan ..... 2-405678[U]
Aug. 6, 1991 [JP] Japan ..... 3-061953[U]

[51] Int. Cl.[5] ..... A45D 40/24; A45D 40/06

[52] U.S. Cl. ..... 401/29; 401/31; 401/98

[58] Field of Search ..... 401/29, 31, 202, 213, 401/98, 30

[56] References Cited

U.S. PATENT DOCUMENTS

| | | | |
|---|---|---|---|
| 2,130,345 | 9/1938 | Freeman | 401/31 |
| 2,513,201 | 6/1950 | Reddeman | 401/31 |
| 2,573,828 | 11/1951 | Braselton | 401/31 |
| 4,560,297 | 12/1985 | Leem | 401/31 |
| 4,911,571 | 3/1990 | Inoue et al. | 401/213 X |
| 5,051,015 | 9/1991 | Moeck | 401/202 |

FOREIGN PATENT DOCUMENTS

| | | | |
|---|---|---|---|
| 53605 | 6/1946 | France | 401/31 |
| 237017 | 8/1945 | Switzerland | 401/31 |
| 268337 | 5/1950 | Switzerland | 401/29 |

*Primary Examiner*—Steven A. Bratlie

[57] ABSTRACT

A twin type stick-shaped material extending container comprised of a base sleeve having first and second concave inner end portions at both ends of the base sleeve. First and second rotary guide sleeves are inserted into the concave inner end portions of the base sleeve. First and second traveling bodies have first and second stick-shaped material receiving bases respectively, slidably fitting in first and second rotary guide sleeves. The first traveling body is inserted in the second traveling body and inserted in the base sleeve. First and second spiral threaded grooves are formed on circumferences of the first and second traveling bodies into which first and second raised portions engage. First and second rotation prevention means regulate the direction of rotation of the first rotary guide sleeve provided on the first and second traveling bodies. The first and second rotary guide sleeves are capped with first and second inner caps respectively detachably attached to outer caps. The rotation of the first rotary guide sleeve makes first stick-shaped material receiving base slide into the first rotary guide sleeve so that a thin eraser is extended from the rotary guide sleeve according to the direction of rotation of the first rotary guide sleeve as the first stick-shaped material receiving base slides into the first rotary guide sleeve.

9 Claims, 3 Drawing Sheets

TWIN-TYPE STICK-SHAPED MATERIAL EXTENDING CONTAINER

This is a continuation of co-pending application Ser. No. 07/805,376 filed on Dec. 9, 1991 now abandoned.

BACKGROUND OF THE INVENTION

1. Field of the Invention

The present invention relates to a twin-type stick-shaped material extending container comprising a base-sleeve which is provided with two extending and withdrawing mechanisms at both ends of the base-sleeve.

2. Description of the Prior Art

A conventional stick-shaped material extending container comprises a tubular body provided with a rotary sleeve having an inner spiral threaded groove around the periphery of the tubular body in such a manner that the rotary sleeve can not travel in an axial direction, but can be rotatable. The tubular body has an axial guide groove. A stick-shaped material holder is inserted into the tubular body with a retaining piece of the stick-shaped material holder being inserted into the guide groove. A projection on the retaining piece is inserted into the spiral threaded groove of the rotary sleeve.

In a conventional container, when the rotary sleeve is turned on the tubular body, a stick-shaped material held by the retaining piece on the stick-shaped material holder is extended or withdrawn from the rotary sleeve according to the direction of rotation of the rotary sleeve. When the usable portion of the stick-shaped material is used up, the rest of the stick-shaped material is removed from the rotary sleeve by pulling it out of the rotary sleeve with one's fingers. However, since the conventional container is not a twin-type container, the thickness of the stick-shaped material is fixed. It is impossible to properly use a thin or thick stick-shaped material according to the thickness or size of line drawing or pattern. Further, in case of lipstick or retouching stick, it is difficult to hold a new lipstick or retouching stick while an unused lipstick or retouching stick is changed, in the retaining piece of the stick-shaped material holder because the fingers are stained by the new lipstick or retouching stick, so the lipstick or retouching stick which has been used up becomes disused together with the container thereof. Therefore the lipsticks or retouching sticks are high-priced.

BRIEF SUMMARY OF THE INVENTION

It is an object of the invention to provide a twin-type stick-shaped material extending container in which it is possible to properly use a thin or thick stick-shaped material on either end according to the thickness or size of line drawing or pattern needed and it is possible to change unused stick-shaped material for new stick-shaped material.

It is another object of the invention to provide a twin-type reversible stick-shaped material extending container in which it is possible to properly use a thin or thick stick-shaped material according to the thickness or size of line drawing or pattern needed and it is possible to change unused stick-shaped material for new stick-shaped material and which is childproof.

The above-mentioned first object is attained by a twin-type stick-shaped material extending container comprising: a base sleeve having first and second concave inner end portions at both end portion of the base sleeve, respectively. First and second rotary guide sleeves have first and second raised portions, respectively, said first and second rotary guide sleeves being inserted into said concave inner end portions of said base sleeve so as to be rotatable with regard to the base sleeve and detachable in the axial direction from the base sleeve. A first traveling body has a first stick-shaped material receiving base fitted slidably in the first rotary guide sleeve and a second traveling body has a second stick-shaped material receiving base fitted slidably in a second rotary guide sleeve, wherein the first traveling body is inserted in the second traveling body, and said first and second traveling bodies are arranged in said base sleeve. First and second spiral thread grooves are formed on peripheries of said first and second traveling bodies into which said first and second raised portions are inserted. First rotation-prevention means are provided for regulating the direction of rotation of the first rotary guide sleeve, said first rotation-prevention means being provided on said first traveling body and a second rotation-prevention means for regulating the direction of rotation of the second rotary guide sleeve, said second rotation means being provided on said second traveling body. The first rotary guide sleeve is capped with a first inner cap, while the second rotary guide sleeve is capped with a second inner cap. First and second outer caps are detachably attached to said first and second inner caps.

In the above-mentioned twintype stick-shaped material extending container, when a line drawing or pattern is thin or small, the first and the second inner caps are detached from the base sleeve, and the first rotary guide sleeve is turned. Since the first raised portion is inserted into the first spiral threaded groove and the direction of rotation of the first guide sleeve is regulated by the rotation-prevention means, a thin stick-shaped material can be extended into the end of the first rotary guide sleeve by sliding the first stick-shaped material receiving base along the inside of the first rotary guide sleeve according the direction of rotation of the first rotary guide sleeve.

Further when a line drawing or pattern is thick or large, the second inner and outer caps are detached from the base sleeve, and the second rotary guide sleeve is turned, causing the thick stick-shaped material to be extended into the end of the second rotary guide sleeve according the direction of the second rotary guide sleeve.

As the container according to the invention is of twin-type, thin or thick stick-shaped materials can be used properly according to the thickness or size of a line drawing or pattern.

Further, the set of the first rotary guide sleeve and the first traveling body having the first stick-shaped material receiving base engaged slidably with the inside of the first rotary guide sleeve can be handled as a first cassette. The set of the second rotary guide sleeve and the second traveling body having the second stick-shaped material receiving base engaged slidably with the inside of the second rotary guide sleeve can be handled as a second cassette. Accordingly, when a stick-shaped material of lipstick or retouching stick is used up, the first and second cassettes to be replaced can be changed for new first and second cassettes in which new stick-shaped material is contained, so the container is reusable.

Since the first rotary guide sleeve is capped with first inner and outer caps while the second rotary guide sleeve is capped with the second inner and outer caps, the first and second rotary guide sleeves are prevented from being operated by mistake. Therefore, stick-shaped materials are prevented from colliding with the first and second inner caps so that the stick-shaped materials are not broken and bent.

The above-mentioned second object is attained by the above-mentioned twin type stick-shaped material extending container according to the invention, said twin-type stick-shaped material extending container further comprises air vent holes formed between the first inner and outer caps and between the second inner and outer caps respectively.

Even if a baby or a child should swallow by mistake the first outer cap with the first inner cap or the second outer cap with the second inner cap and either of them become caught in the throat, the baby or child can breathe through the air vent hole formed between the first inner and outer caps or the second inner cap and the second outer cap, till the baby or the child receives treatment.

Since a cap is a double cap comprised of the first inner and outer caps or the second inner and outer caps, various caps can be formed by modification of the first outer cap and the second outer cap.

DETAILED DESCRIPTION

Figure 1:
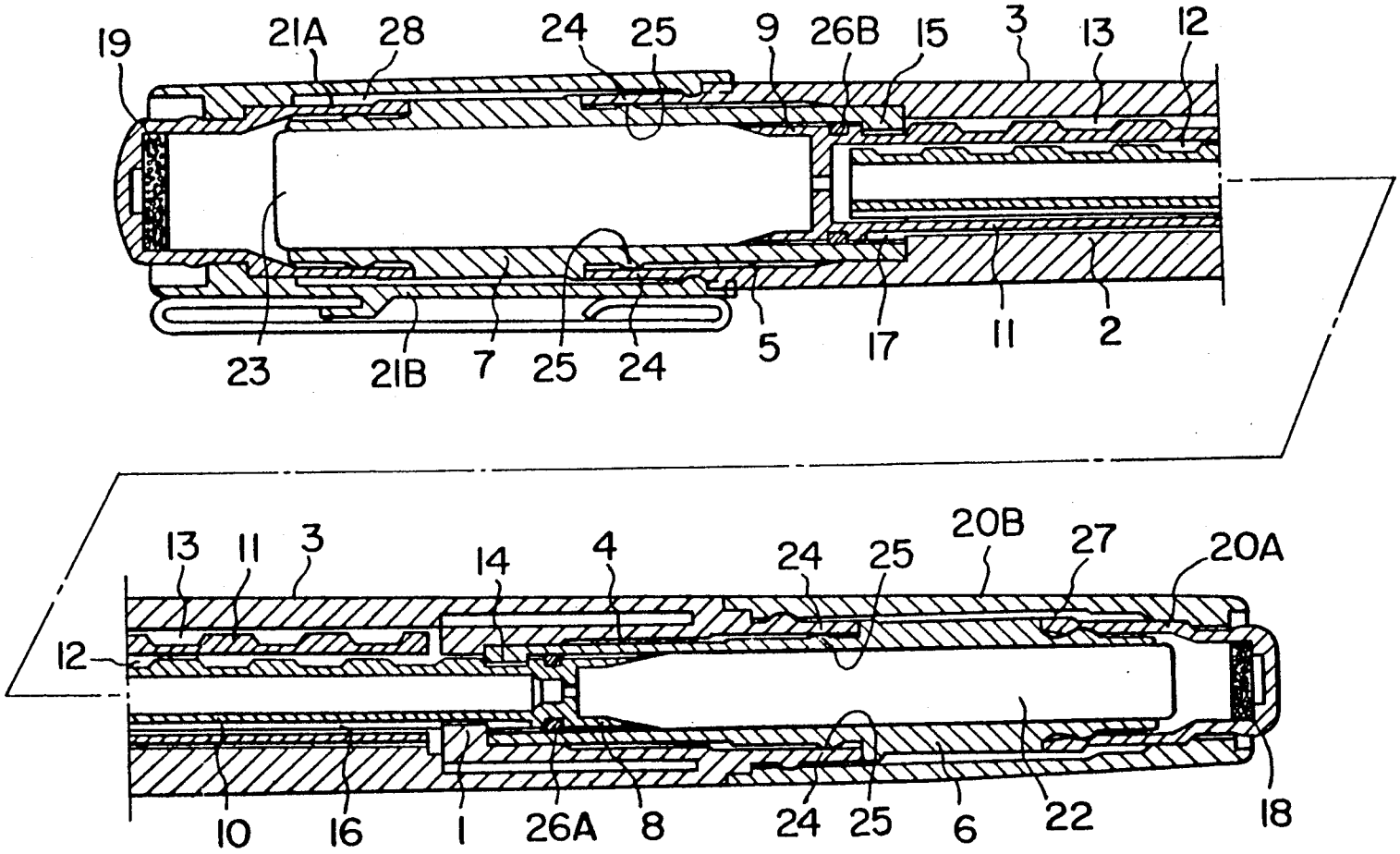
FIG. 1 is a cross-sectional view of one embodiment of this invention.

Referring now to FIG. 1, there is shown a first embodiment of a twin-type or reversible stick-shaped material extending container which is comprised of base sleeve 3 and first and second rotary guide sleeves 6, 7. Base sleeve 3 has first and second projections 1, 2 and first and second concave inner end portions 4, 5, and first and second rotary guide sleeves 6, 7 having first and second raised portions 14, 15. First and second rotary guide sleeves 6, 7 are inserted into first and second concave inner end portions 4, 5, respectively. For example concave portions 24 formed on first and second concave inner end portions 4, 5 are engaged with convex portions 25 formed on first and second rotary guide sleeves 6, 7, so as to be rotatable relative to base sleeve 3 and detachable from base sleeve 3.

First traveling body 10 and second traveling body 11 are inserted into and arranged in base sleeve 3, wherein first traveling body 10 is formed with first stick-shaped material receiving base 8 slidably fitted in first rotary guide sleeve 6, and second traveling body 11 is formed with second stick-shaped material receiving base 9 slidably fitted in second rotary guide sleeve 7. O rings 26A, 26B acting as seals preventing retouching sticks 22, 23 from becoming dried out are inserted between first stick-shaped material receiving base 8 and first rotary guide sleeve 6, and between second stick-shaped eraser receiving base 9 and second rotary guide sleeve 7, respectively.

Figure 2:
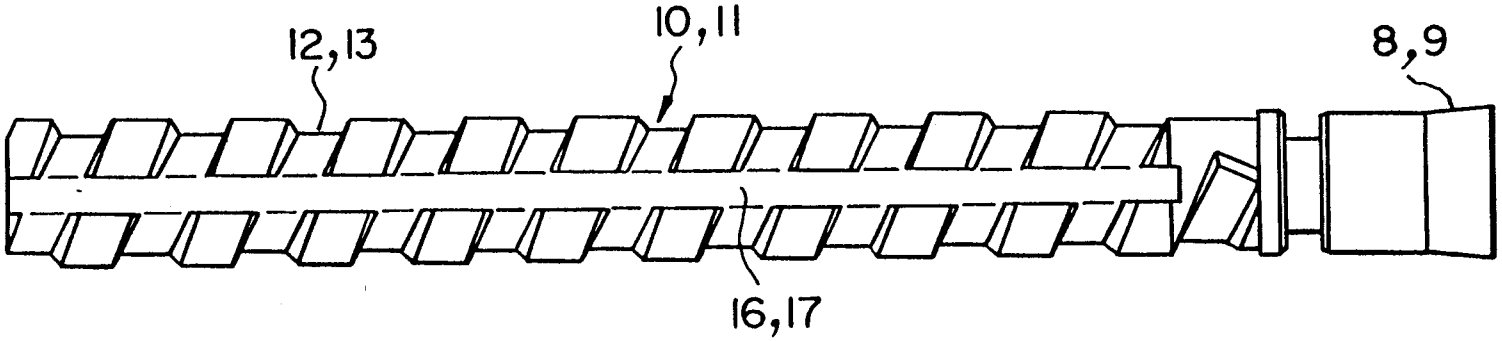
FIG. 2 is a front view of a moving member having a stick-shaped article.
Figure 3:
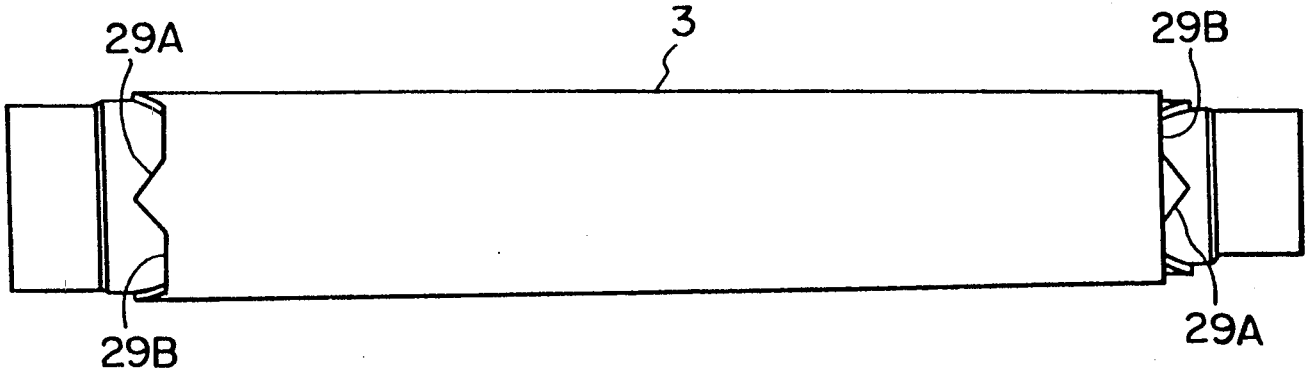
FIG. 3 is a side elevation of one embodiment of a base sleeve for use in the invention.
Figure 4:
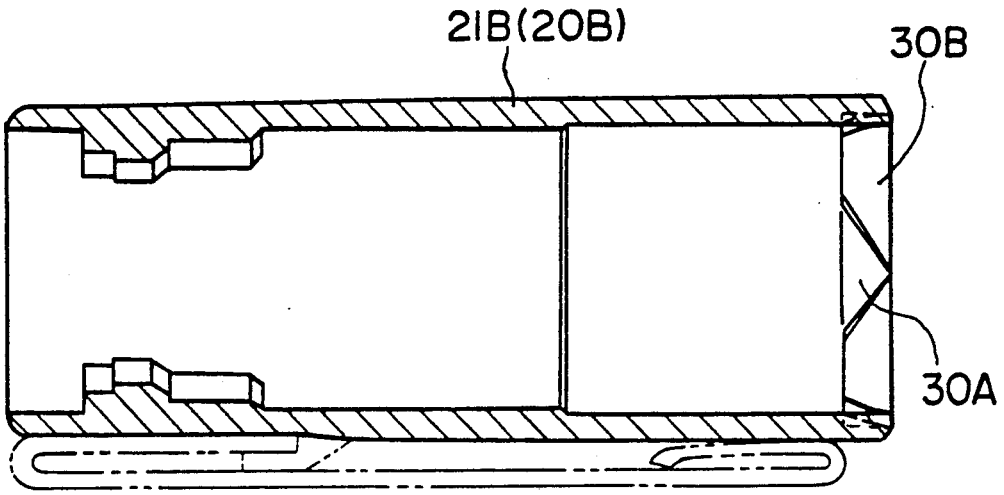
FIG. 4 is a vertical sectional view of one example of an outer cap.

First and second traveling bodies 10, 11 are formed with first spiral thread grooves 12, 13 into which first and second raised portions 14, 15 are inserted respectively, and with first and second axial grooves 16, 17 into which first and second projections 1, 2 are inserted respectively (FIG. 2). First traveling body 10 may be a tubular or pillar-shaped body.

The set of first rotary guide sleeve 6 and first traveling body 10 having first stick-shaped material receiving base 8 slidably fitting in first rotary guide sleeve 6 and the set of second rotary guide sleeve 7 and second traveling body 11 having second stick-shaped material receiving base 9 slidably fitted in second rotary guide sleeve 7 can be handled as first and second cassettes.

Figure 5:
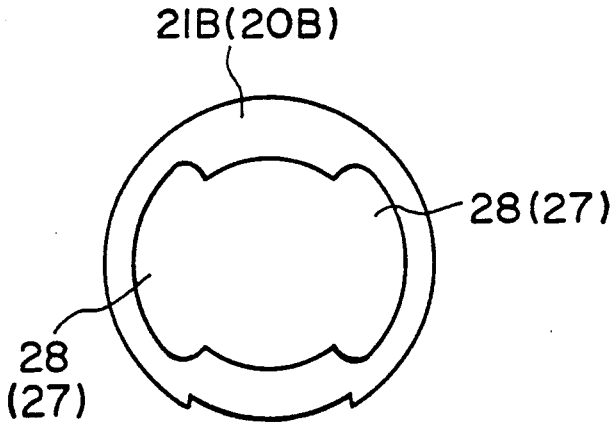
FIG. 5 is a left side view of the example shown in FIG. 4.

First rotary guide sleeve 6 is detachably capped with first inner cap 20A having first antidry agent 18 while second rotary guide sleeve 7 is capped with second inner cap 21A having second antidry agent 19. Air vent hole 27 is formed between first inner cap 20A and first outer cap 20B detachably attached on first inner cap 20A, outside one end of base sleeve 3. Air vent hole 28 is formed between second inner cap 21A and first outer cap 21B detachably attached on first inner cap 21A(-FIG. 5). Base sleeve 3 has a tooth formed of upward portions 29A and downward portions 29B at both end portions of base sleeve A, while first and second outer caps 20B, 21B are formed with a tooth formed of upward portion 30A and downward portion 30B at both the inner end portions of first and second outer caps 20B, 21B. Upward portions 29A of base sleeve 3 engage with downward portions 30B, while downward portions 29B of base sleeve 3 engage with upward portions 30A. When first and second outer caps 20B, 21B are to be detached from base sleeve 3, first and second outer sleeves 20B, 21B are turned with regard to base sleeve 3, allowing first and second outer sleeves 20B, 21B to be detached easily from base sleeve 29.

Use can be made of a fiber made of synthetic resin such as polyester, polyacetate, or elastic material including sponge rubber, acrylic ester resin and others, for first and second antidry agents 18, 19, particularly when stick-shaped material 22, 23 are, for example, retouching sticks from which moisture easily vaporizes. At this time, when eraser stick is dried and becomes unfit for use because base sleeve 3 has been left uncapped, base sleeve 3 is capped with first and second antidry agents 18, 19 soaked with water, and retouching sticks are supplied with water to become usable. First and second antidry agents 18, 19 act also as a cushion for stick-shaped materials, since first and second antidry agents are made of elastic materials as above-mentioned.

Further, the heads of first inner cap 20A, first outer cap 20B, second outer cap 21A and second outer cap 21B have shapes such as a round shape for use as a spatula.

In the above-mentioned embodiment, when a line drawing or pattern is thin or small, first inner cap 20A and first outer cap 20B are detached from base sleeve 3. First rotary guide sleeve 6 is rotated relative to base sleeve 3, allowing thin retouching stick 22 to be extended from the head of first rotary guide sleeve 6. First raised portion 14 of first rotary guide sleeve 6 is inserted in first spiral thread groove 12 of first traveling body 10, and first projection 1 is inserted in first axial groove 16. Thus the rotation of first rotary guide sleeve 6 makes first stick-shaped material receiving base 8 slide into first rotary guide sleeve 6 so that thin retouching stick 22 is extended from the head of rotary guide sleeve 6 according to the direction of rotation of first rotary guide sleeve 6 as first stick-shaped material receiving base 8 slides into first rotary guide sleeve 6.

On the other hand, when a line drawing or pattern is thick or large, second inner cap 21A and second outer cap 21B are detached from base sleeve 3, and second rotary guide sleeve 7 is rotated relative to base sleeve 3, allowing thick retouching stick 23 to be extended from the head of second rotary guide sleeve 7: second raised portion 15 of second rotary guide sleeve 7 is inserted in second spiral thread groove 13 of second traveling body 11, and second projection 2 is inserted in first axial groove 17, and so the rotation of second rotary guide sleeve 7 makes second stick-shaped material receiving base 9 slide into second rotary guide sleeve 7 so that thick retouching stick 23 can be drawn out of the head of second rotary guide sleeve 7 according to the direction of rotation of rotary guide sleeve 6 as second stick-shaped material receiving base 9 slides into second rotary guide sleeve 7.

Accordingly, thin retouching stick 22 and thick retouching stick 23 are extended from the heads of first and second rotary guide sleeves 6, 7 respectively and can be used properly according to the thickness or size of line drawing or pattern, and retouching of the figures can be performed smoothly and quickly without failure.

Further, as for the retouching stick, since the heads of caps 20A, 20B, 21A, 21B have shapes such as a round shape suited for use as a spatula. After erasing has been performed, smooth rewriting or repainting can be performed by using the heads of caps 20A, 20B, 21A, 21B as spatulas.

In this embodiment, a set comprised of first rotary guide sleeve 6 and first traveling body 10 having first stick-shaped material receiving base 8 capped with first rotary guide sleeve 6, and a set comprised of second rotary guide sleeve 7 and second traveling body 11 having second stick-shaped material receiving base 9 capped with second rotary guide sleeve 7 can be handled as first and second cassettes. Therefore, even though the stick-shaped material is lipstick or retouching stick, and has been used up stick-shaped materials 22, 23, unusable the first and second cassettes can be changed for a new first and second cassettes in which new stick-shaped materials are contained, so the container is reusuable.

First rotary guide sleeve 6 is operated by rotation and is capped with first inner cap 20A, and first outer cap 20B, while second rotary guide sleeve 7 operated by rotation is capped with second inner cap 21A, and second outer cap 22B. Thus the first and second rotary guide sleeves 6 and 7 are prevented from being operated by mistake. Accordingly, stick-shaped materials 22, 23 are prevented from colliding with first and second inner caps **20*a*, 21B** so that the stick-shaped materials are prevented from being broken and bent.

Even though a baby or a child should swallow first outer cap 20B with first inner cap 20A or second outer cap 21B with second inner cap 21A and the first outer and inner caps or the second outer and inner caps are caught in one's throat, a baby or child can breathe through the air vent hole formed between the first and second outer caps, till the baby or the child receives treatment.

Since caps are double caps comprised of first inner cap 20A and first outer cap 20B or of second inner cap 21A and second outer cap 21B, various caps can be formed by the modification of first outer cap 20B and second outer cap 21B.

Further, when stick-shaped materials 22, 23 are retouching sticks, retouching fluid is packed in first stick-shaped material receiving base 8 and the inside of first rotary guide sleeve 6, and in second stick-shaped material receiving base 9 and second rotary guide sleeve 7, and a formed insert is made. Thereafter, first and second rotary rotary guide sleeves 6, 7 are capped with first inner cap 20A and first outer cap 21 A, by which retouching sticks are prevented from being dried up. Parts which can be stained by retouching fluid when packing an erasing fluid are covered with first and second outer caps 20B and 21B. Therefore, even though the parts are stained by retouching fluid, it is not necessary to care about being parts stained by retouching fluid.

It goes without saying that use can be made of a stick-shaped eraser rubber, lipstick and others as well as a retouching stick.

It the invention, rotation-prevention means is not limitted to one comprised of first and second projections 1, 2 and first and second longitudinal groove 16, 17 into which first and second projections 1, 2 are inserted. Means for preventing rotation such as polygonal part engaged with each other could also be used.

This invention is not limited by the embodiment shown in the drawings and described in the description, which is given by way of example and not of limitation, but only in accordance with the scope of the appended claims.

What is claimed is:

1. A twin type stick-shaped material extending container comprising;

a base sleeve (3) having first and second cavities (4,5), said first and second cavities (4,5) having first and second projections (1,2) at an inner end providing abutments;

first and second rotatable guide sleeves (6,7), said first and second rotatable guide sleeves (6,7) having raised portions (14,15) at an inner end respectively;

said first and second rotatable guide sleeves (6,7) being inserted in said first and second cavities (4,5) with their inner ends abutting said first and second projections (1,2);

a first axially traveling body (10) slidably fitted in said first rotatable guide sleeve (6), said first axially traveling body having a first stick shaped material receiving recess in its base (8);

a second axially traveling body (11) slidably fitted in said second rotatable guide sleeve (7), said second axially traveling body (11) having a second stick-shaped material receiving recess in its base (9);

said first axially traveling body (10) fitting inside said second axially traveling body (11) inside said base sleeve (3);

said first and second axially traveling bodies (10,11) having peripheral spiral threaded grooves (12,13), said first and second raised portions (14,15) on said first and second rotary guide sleeves (6,7) engaging said peripheral spiral threaded grooves (12,13) respectively;

first and second rotation preventing means on said first and second axially traveling bodies (10,11) for preventing rotation relative to said base sleeve, said first and second rotation preventing means comprising axially grooves (16,17) on said first and second traveling bodies, said first and second projections (1,2) in said first and second cavities (4,5)

engaging said first and second axial grooves (16,17) to prevent rotation while allowing axial travel relative to said base sleeve (3);

detachable securing means (24,25) securing said first and second rotatable guide sleeves (6,7) with said first and second traveling bodies (10,11) in said first and second cavities (4,5) in said base sleeve (3) as completely detachable cassette units that may be easily removed and replaced, said first and second securing means (24,25) allowing said guide sleeves (6,7) to rotate relative to said base sleeve (3);

first and second detachable inner cap means (20A,21A) for capping the ends of said first and second rotatable guide sleeves (6,7);

first and second frictionally retained outer cap means (20B,21B) on said base sleeve (3) engaging said first and second detachable inner cap means (20A,21A);

whereby stick-shaped material may be selectively extended from said base sleeve for easy removal and replacement in cassette form.

2. The container according to claim 1 wherein said first and second detachable inner cap means and first and second frictionally retained outer cap means have smooth outer shapes formed so that they may be used as a spatula.

3. The container according to claim 1 including vent holes (27,28) formed between said first and second detachable inner cap means (20A,21A) and said first and second frictionally retained outer cap means (20B,21B) respectively.

4. The container according to claim 1 in which said first and second detachable inner cap means (20A,21A) accommodate first and second anti-drying agents respectively.

5. The container according to claim 4 in which said anti-drying agent is included in a cavity in an interior end of said first and second detachable inner cap means (20A,21A).

6. A removable container for extending a stick-shaped material from either end comprising;

a base sleeve (3) having first and second cavities (4,5), said first and second cavities (4,5) having first and second projections (1,2) at an inner end providing abutments;

first and second rotatable guide sleeves (6,7), said first and second rotatable guide sleeves (6,7) having raised portions (14,15) at an inner end respectively;

said first and second rotatable guide sleeves (6,7) being inserted in said first and second cavities (4,5) with their inner ends abutting said first and second projections (1,2), said first and second rotatable guide sleeves (6,7) being rotatable and axially detachable from said base sleeve (3);

a first axially movable body (10) slidably fitted in said first rotatable guide sleeve (6), said first axially movable body having a first stick shaped material receiving recess (8) in its base;

a second axially movable body (11) slidably fitted in said second rotatable guide sleeve (7), said second axially movable body (11) having a second stick-shaped material receiving recess (9) in its base;

one of said first and second axially movable bodies (10,11) having a stick-shaped receiving recess (8,9) being larger in diameter than the other stick-shaped material recess (8,9) for receiving different size stick-shaped material in one end than in the other;

said first and second axially movable bodies (10,11) having a peripheral spiral threaded grooves (12,13), said first and second raised portions (14,15) on said first and second rotary guide sleeves (6,7) engaging said peripheral spiral threaded grooves (12,13) respectively;

first and second rotation preventing means on said first and second axially movable bodies (10,11) for preventing rotation relative to said base sleeve, said first and second rotation preventing means comprising axially grooves (16,17) on said first and second movable bodies, said first and second projections (1,2) in said first and second cavities (4,5) engaging said first and second axial grooves (16,17) to prevent rotation while allowing axial travel relative to said base sleeve (3);

detachable securing means (24,25) securing said first and second rotatable guide sleeves (6,7) with said first and second movable bodies (10,11) in said first and second cavities (4,5) in said base sleeve (3) as completely detachable cassette units that may be easily removed and replaced, said first and second securing means (24,25) allowing said guide sleeves (6,7) to rotate relative to said base sleeve (3);

first and second detachable inner cap (20A,21A) means for capping the ends of said first and second rotatable guide sleeves (6,7);

first and second frictionally retained outer cap means (20B,21B) on said base sleeve (3) engaging said first and second detachable inner cap means (20A,21A);

whereby stick-shaped material may be selectively extended from said base sleeve for easy removal and replacement in cassette form.

7. The container according to claim 6 wherein said first and second detachable inner cap means and first and second frictionally retained outer cap means have smooth outer shapes formed so that they may be used as a spatula.

8. The container according to claim 6 in which said first and second detachable inner cap means (20A,21A) accommodate first and second anti-drying agents respectively.

9. The container according to claim 8 in which said anti-drying agent is included in a cavity in an interior end of said first and second detachable inner cap means (20A,21A).

* * * * *